United States Patent [19]

Barlow

[11] 3,994,499

[45] Nov. 30, 1976

[54] BOARD GAME APPARATUS

[75] Inventor: Gordon A. Barlow, Skokie, Ill.

[73] Assignee: Marvin Glass & Associates, Chicago, Ill.

[22] Filed: Apr. 25, 1975

[21] Appl. No.: 571,723

[52] U.S. Cl. ..... 273/134 B; 273/134 C; 273/134 D; 273/134 AT; 273/138 R

[51] Int. Cl.[2] ..... A63F 3/00

[58] Field of Search ..... 273/134

[56] References Cited

UNITED STATES PATENTS

| | | | |
|---|---|---|---|
| 3,594,001 | 7/1971 | Glass et al. | 273/134 B |
| 3,799,550 | 3/1974 | Milana et al. | 273/134 AD |

FOREIGN PATENTS OR APPLICATIONS

| | | | |
|---|---|---|---|
| 220,795 | 8/1957 | Australia | 273/134 C |

*Primary Examiner*—Delbert B. Lowe
*Attorney, Agent, or Firm*—Coffee and Sweeney

[57] ABSTRACT

A board game apparatus based on a theme of food item sales, where the object is to become the best sales person determined on the basis of the largest amount of sales. The game generally includes a gameboard having a playing surface thereon, a playing piece for each player of the game, a track defining a playing piece path of travel on the playing surface, and a chance device for determining the advancement of the playing pieces along the track. The board game apparatus includes a set of menu playing cards, each having indicia thereon representative of a plurality of food items, such as hamburgers, fries, or the like, which may be ordered, and a set of food item cards carrying indicia representative of one of the food items on the menu cards which may be used to fill an order as required by one of the menu cards. The track has a plurality of stations including menu card stations having indicia thereon permitting a player of the game to select a card from the set of menu cards should his playing piece land on that station. The players of the game attempt to accumulate cards from the set of food item cards including all of the items ordered by one of the menu cards as rapidly as possible to achieve a match. The player who first accumulates such a set of food item cards matching the corresponding items on a menu card is awarded a number of sales determined by rolling a die. The board game apparatus includes a device for determining which of the players of the game is first to perform a match.

7 Claims, 4 Drawing Figures

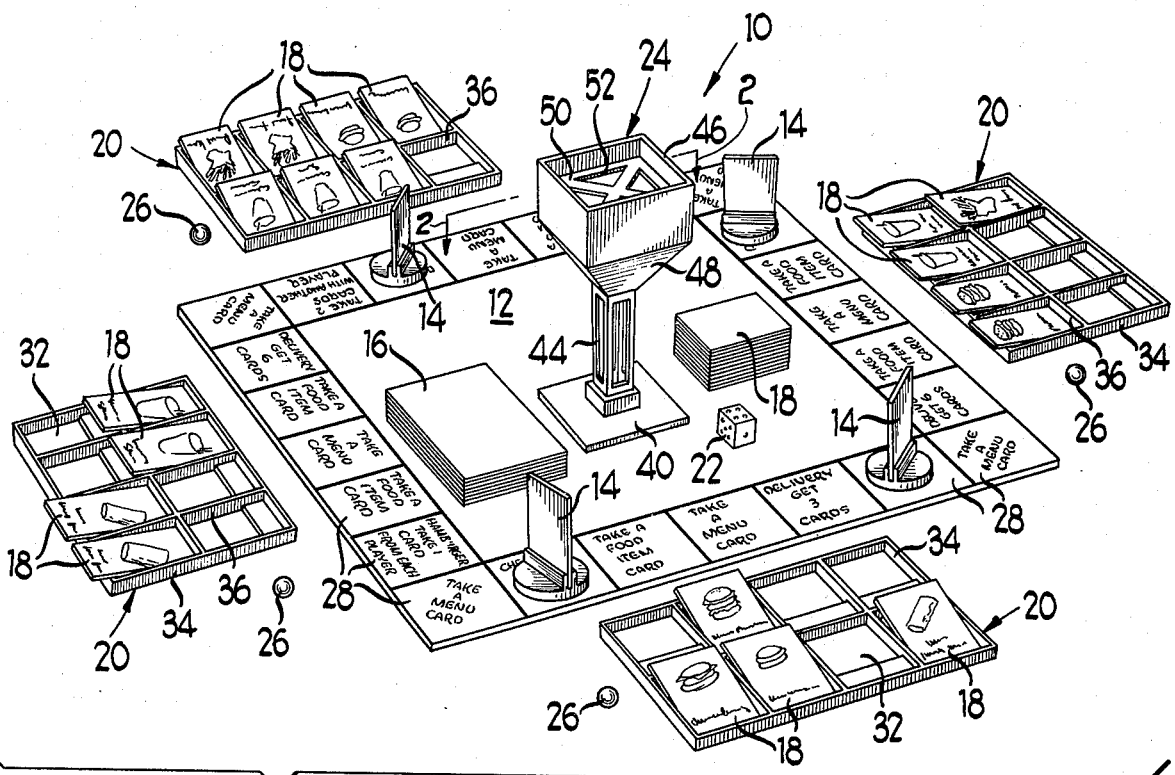
Fig 1
Fig 2
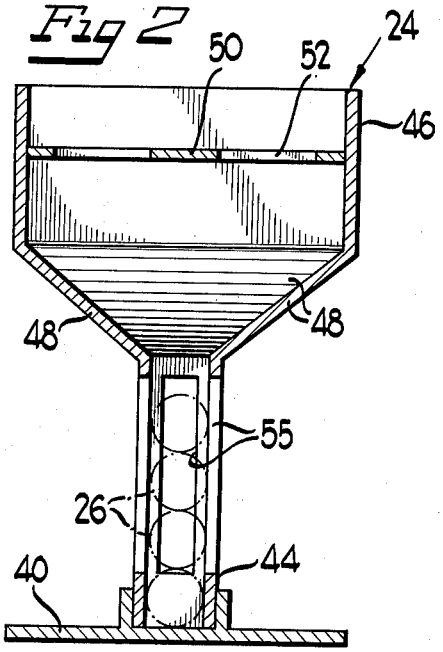
Fig 3
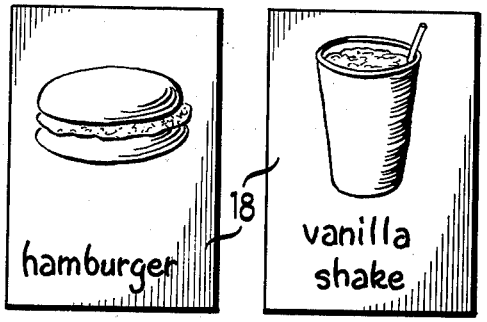
Fig 4
16
| NO. OF | ITEMS |
|---|---|
| | VANILLA SHAKE |
| 2 | CHOCOLATE SHAKE |
| 2 | BURGER DELUXE |
| 1 | CHEESEBURGER |
| | HAMBURGER |
| 1 | FRIES |
| | COFFEE |
| 1 | HOT APPLE PIE |
| | |
| | |
| | |
30
| NO. OF | ITEMS |
|---|---|
| | FRIES |
| 2 | HOT APPLE PIE |
| 2 | VANILLA SHAKE |
| | HAMBURGER |
| | COFFEE |
| | CHEESEBURGER |
| 2 | BURGER DELUXE |
| | CHOCOLATE SHAKE |
| | |
| WAIT! CHANGE THE SHAKES TO 2 COFFEES | |
30

BOARD GAME APPARATUS

BACKGROUND OF THE INVENTION

1. Field of the Invention

The present invention relates to board games and more particularly to a board game including co-extensive sets of cards in which the object is to amass the greatest number of sales awarded to players who first accumulate a matching set.

2. Brief Description of the Prior Art

Board games have enjoyed a great deal of popularity throughout the years. One form of board game which has been popular is the type in which the object is to accumulate wealth in the form of simulated money or the like. However, most board games rely, for the most part, solely on an element of chance for determining the manner and amount of simulated money acquired by a player of the game.

SUMMARY OF THE INVENTION

An object of the present invention is to provide a new and entertaining board game using a plurality of sets of cards wherein a sub-set of cards from one set of cards matches items on one of the cards from the other set of cards. The matching and accumulating of the sub-set requires dexterity and quick recognition on the part of the players of the game.

Other objects, features and advantages of the invention will be apparent from the following detailed description taken in connection with the accompanying drawings.

These and other objects of the invention are accomplished in one embodiment currently contemplated which provides for a gameboard having a playing surface thereon, a plurality of playing pieces, at least one for each player of the game, a plurality of stations on the playing board to define a playing piece path of travel, and a chance device for determining the advancement of the playing pieces along the track. In the preferred embodiment, there also are provided a set of menu cards and a set of food item cards, whereby a sub-set of the set of food item cards can define a match of the menu on one of the cards from the set of menu cards. A timing device is provided to determine which one of the players of the game is first to compile a matching set of food item cards, and a chance device is provided to determine the number of sales awarded to a particular player and for determining how many stations a particular playing piece is to be advanced along the path of travel.

BRIEF DESCRIPTION OF THE DRAWINGS

FIG. 1 is a perspective view of the board game apparatus embodying the concepts of the present invention;

FIG. 2 is a vertical section, on an enlarged scale, of the timing device, taken generally along line 2—2 of FIG. 1;

FIG. 3 is a top plan view of two of the plurality of food item cards of the game apparatus of the present invention; and FIG. 4 is a top plan view of two of the plurality of menu cards of the game apparatus of the present invention.

DESCRIPTION OF THE PREFERRED EMBODIMENT

The gameboard apparatus, generally designated 10, of the present invention is shown in FIG. 1. The apparatus includes a gameboard 12, a plurality of playing pieces 14, a set of menu cards 16, and a set of food item cards 18. A card rack, generally designated 20, is provided for each player of the game for supporting a plurality of food item cards 18, as will be described in detail hereinafter. A chance device in the form of a die 22 is provided for determining the advancement of the playing pieces and for other purposes, as will be described hereinafter. A timing device, generally designated 24, for use with a plurality of balls 26 associated with the players of the game, is provided to determine which player first has completed a task time.

The gameboard 12 includes a plurality of stations 28 around the perimeter thereof to define a path of travel for the playing pieces 14. Each station 28 includes indicia thereon which instructs the player whose playing piece lands thereon to perform a specific act. For example, the indicia "take a food item card" permits the player to take a card from the food item set of cards 18. Similarly, the "delivery" stations permit the player to take more than one card from the set of food item cards 18 while other stations permit a player to take a card from one of the players of the game.

The stations carrying the indicia "take a menu card" permit the player whose playing piece lands on that station to take one of the menu cards 16 from the set of menu cards. The menu cards 16 have indicia thereon representative of a list of items that may be ordered, for example, from a fast food restaurant, such as fries, hamburgers, coffee, etc. (See FIG. 4) A column 30 to the left of the list of food items on the menu cards 16 includes indicia representative of the number of particular food items which are ordered by the menu cards 16. For example, the card at the left of FIG. 4 orders two chocolate shakes, two burgers deluxe, one cheeseburger, one order of fries and one hot apple pie. Similarly, the remaining cards 16 of the set of menu cards represent orders for varying amounts of different food items.

The food item cards 18, shown in FIG. 3, represent food items identical to those on the menu cards 16 and are used to fill the orders represented by the menu cards. A plurality of food item cards 18 are distributed to each player of the game according to the dictates of the rules and are stored in view of each player by one of the racks 20. There are eight categories of food item cards and each rack 20 is provided with eight card slots 32 defined by side walls 34 and transverse ribs 36 of each rack 20.

During the play of the game, the players compete against one another in attempting to be the first to fill an order from a menu card by selecting the food item cards 18 from their respective rack 20.

The device 24 is provided to facilitate the accurate determination of which player is the first one to fill the order. The timing device 24 includes a stabilizing base 40, a vertical column 44 removably mounted to the base and a ball receiving portion or funnel 46 mounted on top of the column. The ball receiving portion 46 includes a plurality of depending tapered walls 48 which converge and are connected to the top of the column 44. A baffle plate 50 is mounted within the upper, open end of the ball receiving portion 46 and includes a plurality of generally triangular openings 52 therein, one along each side of the receiving portion 46. The column 44 is provided with a plurality of generally rectangular slots 55, one on each side of the column 44, to enable the players of the game to view the inside of the column. During the play of the game, as soon as a player has compiled a set of food item cards 18 to fill an order on a menu card 16, he "throws" his ball 26 into the ball receiving portion 46 of the timing device 24. The ball will fall through the baffle plate 50 and be directed into the column 44. The player whose associated ball 26 is on the bottom of the stack of balls 26 within the column 44 is declared to be the first player to successfully compile the order. The baffle plate 50 is functional for the dual purpose of (a) requiring manual dexterity by a player in depositing a ball through one of the openings 52, and (b) providing an element of luck should a ball bounce off of the baffle.

In one scheme of play of the game, two to four players compete in an attempt to accumulate the most sales. Each player places his playing piece 14 on a corner station 28 and is given 24 food item cards 18, three of each type. The players take turns rolling the die 22 and moving clockwise around the path of travel on the gameboard 12. On some of the stations, as described above, the players merely follow the self-explanatory instructions printed on the station. When a player's playing piece 14 lands on a "take a menu card" station 28, he draws one of the menu cards 16 from the stack of menu cards. He then places an "order" by reading aloud the items called for by the card 16. The other players of the game attempt to be the first to fill the order, taking food item cards 18 from their racks 20. As soon as the players compile a correct number of food item cards 18 to fill the order, they place their balls 26 in the device 24 in order to determine which player has completed the order first. The player whose ball 26 is at the bottom of the column 44 has filled the order first. If a player has correctly filled the order from the menu card 16, he is awarded a particular number of sales. The number of sales is determined by a roll of the die and the number coming up represents numerical millions of sales. The player who has read the menu card 16 receives the food item cards 18 to add to his rack 20.

If a player has incorrectly compiled a set of food item cards 18 which does not fill the order, he must give the food item cards 18 to the player who has read the order, but he may not roll the die and he does not receive a score.

If a player accumulates more than three of each type of food item cards 18, he may trade all of his extra cards 18 for sales, each card being returned to the stack representing one million sales. Thus, it can be seen that it is desirable to have as many food item cards 18 as possible so that one can be sure to be able to fill an order and also because extra cards can be turned in for sales. The first player to accumulate a given number of millions of sales is declared the winner.

The foregoing detailed description has been given for clearness of understanding only and no unnecessary limitations should be understood therefrom as some modifications will be obvious to those skilled in the art.

I claim:

1. A board game apparatus, comprising:

a gameboard having a playing surface thereon;

a plurality of playing pieces, at least one for each player of the game;

a first set of playing cards, at least some of said first set of playing cards having indicia thereon representative of a given combination of saleable items;

a second set of playing cards, at least some of said second set of playing cards having indicia thereon identical to the indicia representing one of the items on a card from said first set, whereby a sub-set of cards from said second set of playing cards can define a match with the given combination of saleable items on one of the playing cards from said first set thereof;

a plurality of stations on the gameboard defining a playing piece path of travel, including card stations permitting a player to select a card from said first set should his playing piece land on that particular card station, whereby the remaining players can simultaneously compete to compile a sub-set of cards from said second set in an attempt to match the combination on said selected card from the first set;

a chance device for determining how many stations a particular playing piece is to be advanced by a player along said path; and player actuatable means to facilitate identification of the first player of the game to compile a matching sub-set of cards from said second set by indicating which player has first actuated said means.

2. The board game apparatus of claim 1 wherein said path of travel is closed.

3. The board game apparatus of claim 1 wherein the first set of playing cards are menu cards, the indicia on said menu cards representing different combinations of edible items which may be sold and the second set of playing cards are food item cards, the indicia on said food item cards being identical to at least one of the edible items represented by the menu cards.

4. The board game apparatus of claim 1 wherein the path of travel includes indicating means defining at least some delivery stations which permit a player, whose playing piece lands thereon, to acquire a stated number of additional cards from said second set of playing cards.

5. The board game apparatus of claim 1 wherein the path of travel includes indicating means defining at least one advantage station which permits a player, should his playing piece land thereon, to acquire one or more cards of the second set from the other player of the game.

6. A board game apparatus, comprising:

a gameboard having a playing surface thereon;

a plurality of playing pieces, at least one for each player of the game;

a set of menu cards, at least some of the menu cards having indicia thereon representative of a given combination of edible items;

a set of food item cards, at least some of said food item cards having indicia thereon identical to one of the edible items represented on a card from said menu set, whereby a sub-set of food items cards may define a match with the given combination of edible items on one of the menu cards;

a plurality of stations on the gameboard defining a playing piece path of travel, including delivery stations which permit a player, should his playing piece land thereon, to acquire a stated number of additional food item cards, advantage stations which permit a player, should his playing piece land thereon, to acquire one or more food item cards from the other players of the game, and card stations permitting a player to select a menu card should his playing piece land on that particular card station, whereby the remaining players can compete to compile a sub-set of food item cards in an attempt to match the combination on said selected menu cards;

means for determining how many stations a particular playing piece is to be advanced by a player along said path of travel; and means including a generally vertical column having an upwardly diverging upper portion adapted to receive objects from the players of the game so that the bottommost object within the column identifies the associated player as the one first to place the object into said means.

7. A board game apparatus, comprising:

a gameboard having a playing surface thereon;

a plurality of playing pieces at least one for each player of the game;

a first set of playinc cards, at least some of said first set of playing cards having indicia thereon representative of a given combination of saleable items;

a second set of playing cards, at least some of said second set of playing cards having indicia thereon representative of one of the items represented on a card from said first set, whereby a sub-set of cards from said second set of playing cards can define a match with the given combination of saleable items on one of the playing cards from said first set thereof;

a plurality of stations on the gameboard defining a playing piece path of travel, including card stations permitting a player to select a card from said first set should his playing piece land on that particular card station, whereby the remaining players can compete to compile a sub-set of cards from said second set in an attempt to match the combination on said selected card from the first set;

means for determining how many stations a particular playing piece is to be advanced by a player along said path; and means including a generally vertical column having an upwardly diverging upper portion adapted to receive objects from the players of the game so that the bottommost object within the column defines the associated player as the one first to place the object into said means.

* * * * *